US005694644A

United States Patent [19]

Farnworth et al.

[11] Patent Number: 5,694,644

[45] Date of Patent: Dec. 9, 1997

[54] SURVIVAL PARKA

[75] Inventors: Brian Farnworth, Delta; Naomi Vidal, Langley, both of Canada

[73] Assignee: M.E.T.A. Research Inc., Canada

[21] Appl. No.: 795,275

[22] Filed: Sep. 17, 1996

Related U.S. Application Data

[63] Continuation of Ser. No. 438,577, May 10, 1995, abandoned.

[51] Int. Cl.[6] ..... A41D 1/02; A41D 3/00; A41D 13/00

[52] U.S. Cl. ..... 2/93; 2/108; 2/86

[58] Field of Search ..... 2/93, 94, 108, 2/2.14, 2.15, 2.16, 2.17, 86

[56] References Cited

U.S. PATENT DOCUMENTS

| | | | |
|---|---|---|---|
| 2,437,223 | 3/1948 | Dutrow | 2/94 |
| 3,643,264 | 2/1972 | Rector | 2/2.17 |
| 4,015,300 | 4/1977 | Hayward et al. | 2/217 X |
| 4,165,792 | 8/1979 | Ho | 2/108 |

*Primary Examiner*—C. D. Crowder
*Assistant Examiner*—Shirra L. Jenkins
*Attorney, Agent, or Firm*—C. A. Rowley

[57] ABSTRACT

A parka is formed with a substantially rhomboid shaped beaver tail secured at the center and adjacent to the bottom of the back of the parka and is movable from a stored position to a deployed operative position wherein it extends between the legs and part way up the front of the parka, thereby to pull the bottom circumferential edge of the parka into close relationship with the top, the outside of the legs of the wearer while the beaver tail is in close contact with the inside of the legs in the crotch area to provide a better sealed garment.

13 Claims, 1 Drawing Sheet

SURVIVAL PARKA

FIELD OF INVENTION

This application is a continuation of application Ser. No. 08/438,577 filed May 10, 1995, now abandoned.

The present invention relates to a parka, more particularly, the present invention relates to a flotation parka incorporating an improved beaver tail structure.

BACKGROUND OF THE INVENTION

The concept of providing a beaver tail that is movable from a stored position to a deployed position wherein it extends between the legs of the wearer is not new and is disclosed, for example, in U.S. Pat. No. 4,015,300 issued Apr. 5,1977 to Hayward et al.

In this arrangement, the bottom edge of the parka must be positioned relatively high so that when the beaver tail is deployed, the lateral flaps at the back of the beaver tail may be extended around the upper portion of the leg and folded around in front to be fastened to corresponding flaps on the front portion of the beaver tall to form, in effect, a diaper like structure and then the front portion is secured to the front of the parka to hold the front of the so-formed diaper like structure in place.

It will be apparent that this is a relatively complicated device and that it requires significant amount of material and is not easily deployed and refastened to provide the required protection.

BRIEF DESCRIPTION OF THE PRESENT INVENTION

It is an object of the present invention to provide an improved parka structure including a simple but effective beaver tail that combines with the parka structure when the beaver tall is deployed to substantially seal the parka around the tops of the legs.

Broadly, the present invention relates to a parka comprising a body portion coveting the upper torso of a wearer and having a pair of front portions and a back portion, means to releasably secure said front portions together to form a closed front on said parka, each of said front and back portions having a lower edge which combine to define a circumferential bottom edge of said parka when said parka is worn by said wearer and said front portions are secured together, said body portion having a length to ensure said circumferential bottom edge is positioned adjacent to the crotch of said wearer, a beaver tail forming flap connected at the center of lower edge of said back portion, said beaver tail having a tapered shape with its periphery defined by a longer end and a shorter end with adjacent ends of said longer and shorter ends connected by side edges, means connecting said longer end to said back covering panel adjacent to said bottom edge of said back panel, a connecting means adjacent to said shorter end, said side edges being spaced apart wider than the normal spacing between the legs of said wearer in an area adjacent to said crotch, so that said side edges are in close relationship one with each leg of the wearer, cooperating connecting means on the said front portions to secure said connecting means to said front portions to retain said beaver tail flap in a deployed operative position with said beaver tail flap snugly in position to ensure said circumferential bottom edge is in close relationship with the legs of said wearer.

Preferaby the shorter end when said beaver tale flap is in said deployed operative position is significantly higher than said longer end Preferably said bottom edge will include means to hold said circumferential bottom edge in snug relationship with the body of said wearer.

Preferably said means to hold will comprise a draw string.

Preferably, said connecting means on said flap will be formed by a pair of loops secured to said beaver tail flap, one adjacent to each end of said shorter end and said cooperating means will comprise clip means positioned one on each of said front panels adjacent said means to releasably secure.

Preferably, said beaver tail flap will be held in stored position by cooperating hook and loop fastener means on said back panel and said flap adjacent to said shorter end.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
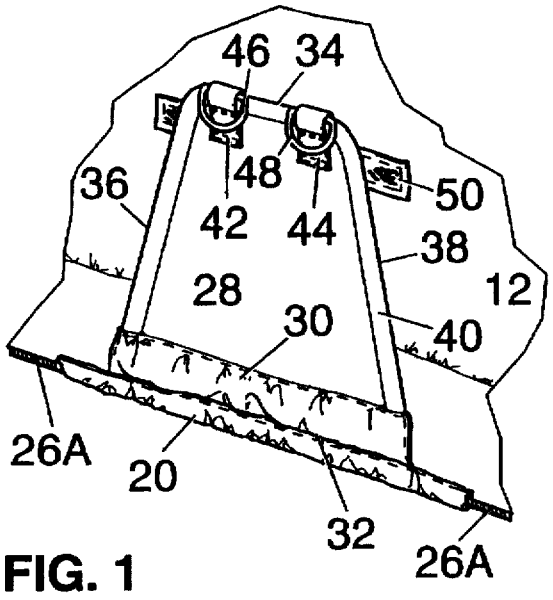
FIG. 1 is a view of a beaver tail constructed in accordance with the present invention shown in stored position on the back portion of a parka.

As shown in FIG. 1, the parka 10 (shown in more detail in FIG. 3) has a back portion 12 (see FIGS. 1 and 2) and a pair of from portions 14 and 16 which are secured together to form the body portion of the parka. The from portions 14 and 16 may be releasably secured together by a releasable closure schematically indicated at 18 and which may take the form of a zipper, buttons, hook and loop fasteners, etc. Each of these portions 12, 14 and 16 has a bottom edge 20 (FIGS. 1 and 2) and 22 and 24 respectively (see FIG. 3) which combine to form a circumferential bottom edge of the parka generally indicated by the number 26.

The bottom edge 26 may be elasticized but preferably is provided with a draw string 26A which is fixed in tightened relationship around the wearer to hold the edge 26 in hugging relationship with the body of the wearer. When the from portions are closed the draw string 26A is tightened and held by a suitable adjustable connector such as adjustable barrel locks (not shown) and the beaver tail flap 28 is in deployed operative position shown in FIG. 3, the bottom of the parka is substantially sealed which makes the parka of the present invention particularly suited for use as survival type floatation garment,.

The beaver tail flap 28 is secured to the back portion 12 adjacent to the center thereof and along the bottom edge 20 as indicated by the joint forming strip 30 which is sewn in to the bottom seam or the like and to the flap 28.

The flap 28 has a longer end 32 and a shorter end 34 interconnected by a pair of side edges 36 and 38 that are symmetrical relative to a longitudinal center line of the flap 28 and define a substantially rhomboid shape.

Preferably, a reinforcing ribbing 40 extend along the circumference of the flap 28 at least along the sides 34, 36 and 38.

As can be seen, the longer end 32 is secured to the back portion 12 adjacent to the bottom edge 20. A pair of folded over strips 42 and 44 secured to the flap 28 adjacent to opposite ends of the shorter end 34 secure loops 46 and 48 to the shorter end 34 of the flap 28.

Figure 2:
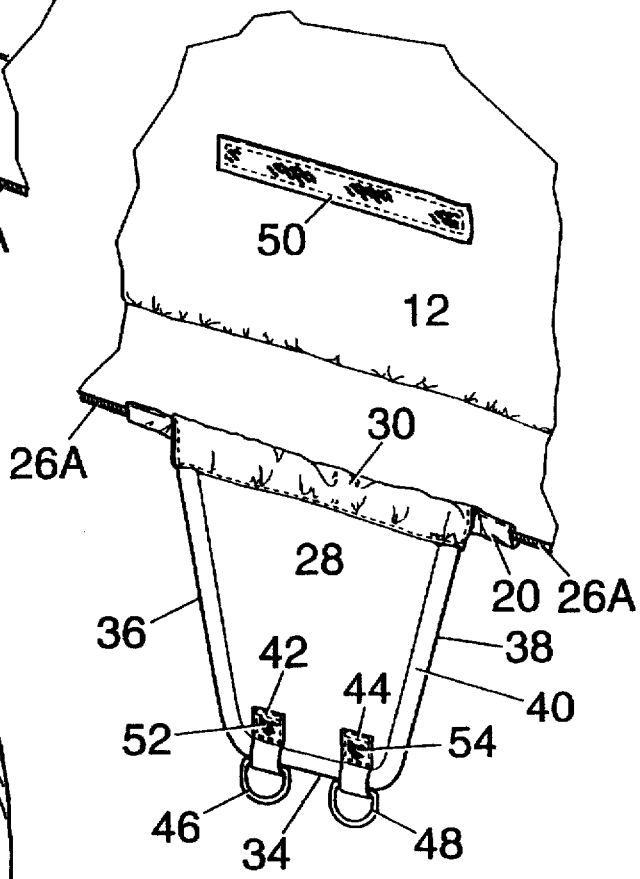
FIG. 2 is a view similar to FIG. 1 but showing the beaver tail in partially deployed position.

A strip of a hook and loop fastener or the like 50 is secured to the back portion 12 and cooperating patches of such hook and loop fastener 52 and 54 are secured to the strip 42 and 44 (see FIG. 2). The patches 52 and 54 engage the strip 50 to hold the flap 28 in stored position.

Figure 3:
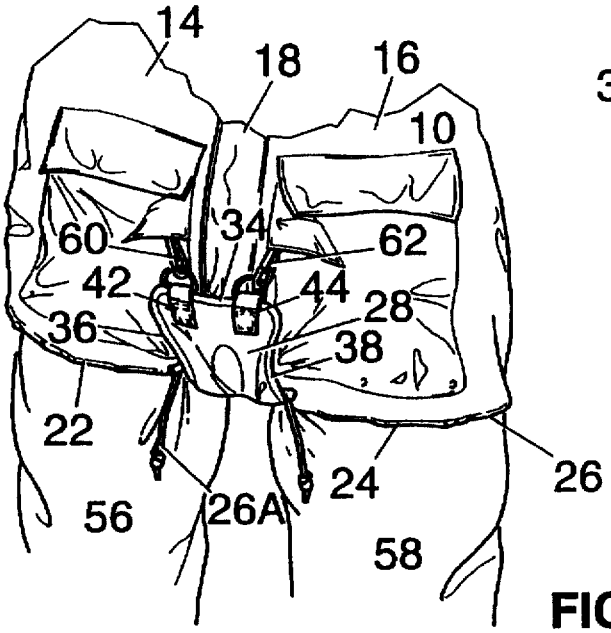
FIG. 3 is a view of a parka incorporating the beaver tail shown in deployed operative position on a wearer.

When the flap 28 is deployed, the edge 34 becomes a free edge and is pulled up between the legs 56 and 58 of the wearer as indicated in FIG. 3 and part way up the front portions 14 and 16 to a position where the clips 60 and 62 are engaged with the loops 46 and 48, so that the shorter edge 34 is significantly higher on the body of the wearer than the longer edge 32.

It will be apparent that by pulling the flap 28 up and into the position shown in FIG. 3 and by forming the circumferential dimension of the bottom edge 26 so that it is relatively dose to the outer periphery of the legs 56 and 58, the movement of the flap 28 into operative position helps to force the circumferential bottom edge 26 toward the legs 56 and 58 while the edges 36 and 38 of the flap 28 are spaced wider than the space between the legs of the wearer and tend to make a seal with the other clothes of the wearer on the inside of the legs so that a relatively tight garment is provided that provides the required insulation yet is simply and easily deployed by simply pulling the flap away from to disconnect the hook and loop fastener and easily fastened into position without the requirement of added seals around the legs.

When the circumferential bottom edge of the parka is elasticized the hugging relationship of the bottom edge 26 to the body is better ensured.

Having described the invention, modifications will be evident to those skilled in the art without departing from the scope of the invention as defined in the appended claims.

We claim:

1. A survival parka comprising a body portion covering the upper torso of a wearer and having a pair of front portions and a back portion, means to releasably secure said front portions together to form a closed front on said parka, each of said from and back portions having a lower edge which combine to define a circumferential bottom edge of said parka when said parka is worn by said wearer and said front portions are secured together, said body portion having a length to ensure said circumferential bottom edge is positioned to substantially encircle said wearer at a level on said wearer adjacent to the crotch of said wearer, a beaver tail forming flap, said beaver tail having a tapered shape with its periphery defined by a longer end and a shorter end with adjacent ends of said longer and shorter ends connected by side edges, means connecting said longer end to said back covering panel to extend from said bottom edge symmetrically relative the center of said bottom edge of said back panel, a connecting means adjacent to said shorter end, said side edges being spaced apart wider than the normal spacing between the legs of said wearer at said level adjacent to said crotch, so that said side edges are in close relationship one with each leg of the wearer and form a seal along adjacent inside portions of said legs, cooperating connecting means on the said front portions to secure said connecting means to said front portions to retain said beaver tale flap in a deployed operative position with said beaver tail flap snugly in position to force said circumferential bottom edge into close relationship with the legs of said wearer at said level adjacent to said crotch.

2. A parka as defined in claim 1 wherein said beaver tail flap is held in a stored position by cooperating hook and loop fastener means on said back panel and said flap adjacent to said shorter end.

3. A parka as defined in claim 1 wherein said shorter end when said beaver tale flap is in said deployed operative position is significantly higher than said longer end.

4. A parka as defined in claim 3 wherein said circumferential bottom edge includes means to hold said circumferential bottom edge in snug relationship with the body of said wearer.

5. A parka as defined in claim 4 wherein said connecting means on said flap is formed by a pair of loops secured to said beaver tail flap, one adjacent to each end of said shorter end and said cooperating means comprises clip means positioned one on each of said front panels adjacent said means to releasably secure.

6. A parka as defined in claim 5 wherein said beaver tail flap is held in a stored position by cooperating hook and loop fastener means on said back panel and said flap adjacent to said shorter end.

7. A parka as defined in claim 6 wherein said means to hold comprises a tightenable draw string.

8. A parka as defined in claim 5 wherein said means to hold comprises a tightenable draw string.

9. A parka as defined in claim 4 wherein said beaver tail flap is held in a stored position by cooperating hook and loop fastener means on said back panel and said flap adjacent to said shorter end.

10. A parka as defined in claim 9 wherein said means to hold comprises a tightenable draw string.

11. A parka as defined in claim 4 wherein said means to hold comprises a tightenable draw string.

12. A parka as defined in claim 3 wherein said connecting means on said flap is formed by a pair of loops secured to said beaver tail flap, one adjacent to each end of said shorter end and said cooperating means comprises clip means positioned one on each of said from panels adjacent said means to releasably secure.

13. A parka as defined in claim 12 wherein said beaver tail flap is held in a stored position by cooperating hook and loop fastener means on said back panel and said flap adjacent to said shorter end.

* * * * *